US007771161B2

(12) United States Patent
Bättig et al.

(10) Patent No.: US 7,771,161 B2
(45) Date of Patent: Aug. 10, 2010

(54) ADJUSTABLE GUIDE DEVICE

(75) Inventors: Josef Bättig, Egliswil (CH); Jean-Yves Werro, Untersiggenthal (CH); Janpeter Kühnel, Bülach (CH)

(73) Assignee: ABB Turbo Systems AG, Baden (CH)

( * ) Notice: Subject to any disclaimer, the term of this patent is extended or adjusted under 35 U.S.C. 154(b) by 708 days.

(21) Appl. No.: 11/654,600

(22) Filed: Jan. 18, 2007

(65) Prior Publication Data

US 2007/0172347 A1 Jul. 26, 2007

(30) Foreign Application Priority Data

Jan. 23, 2006 (EP) ..... 06405028.9

(51) Int. Cl.
*F01D 17/16* (2006.01)

(52) U.S. Cl. ..... 415/160; 415/162; 416/204 R

(58) Field of Classification Search ..... 415/159, 415/160, 161, 162, 163, 164, 148, 155, 209.3, 415/209.4, 210.1
See application file for complete search history.

(56) References Cited

U.S. PATENT DOCUMENTS

| | | | | |
|---|---|---|---|---|
| 4,726,744 | A | | 2/1988 | Arnold |
| 4,792,277 | A | * | 12/1988 | Dittberner et al. ..... 415/160 |
| 5,184,459 | A | | 2/1993 | McAndrews |
| 5,380,152 | A | | 1/1995 | Sikorski et al. |
| 5,518,365 | A | | 5/1996 | Baets et al. |

FOREIGN PATENT DOCUMENTS

| | | |
|---|---|---|
| DE | 102 09 172 A1 | 9/2003 |
| EP | 1 234 950 A1 | 8/2002 |
| EP | 1 396 621 A1 | 3/2004 |

* cited by examiner

*Primary Examiner*—Edward Look
*Assistant Examiner*—Dwayne J White
(74) *Attorney, Agent, or Firm*—Buchanan Ingersoll & Rooney PC

(57) ABSTRACT

Guide vanes are supported in a two-part or multipart housing (32, 33). Housing separation takes place radially in the region of the bearing point (25) of the vane shaft so that the separating joint (36) between the housing parts (32, 33) leads through the bearing openings (34) which are designed to hold the vane shafts. The completely round opening (34) leads to the bearing point of the vane shaft having large-area support in any position. Thus high surface pressures can be avoided.

17 Claims, 2 Drawing Sheets

ADJUSTABLE GUIDE DEVICE

CROSS REFERENCE TO RELATED APPLICATION

This application claims priority under 35 U.S.C. §119 to European Application 06405028.9 filed in on 23 Jan. 2006, the entire contents of which is hereby incorporated by reference in its entirety.

FIELD

The disclosure relates to the field of hydrodynamic machines pressurized with exhaust gases of internal combustion engines. It relates to an adjustable guide device of the exhaust gas turbine or of the compressor of an exhaust gas turbocharger, a compressor and an exhaust gas turbine with such a guide device, an exhaust gas turbocharger with such a compressor and/or with such an exhaust gas turbine and a guide vane for an adjustable guide device.

BACKGROUND INFORMATION

Exhaust gas turbochargers are used to boost the output of internal combustion engines. In modern internal combustion engines, matching the exhaust gas turbocharger to variable operating conditions is becoming increasingly more difficult. So-called variable turbine or compressor geometry offers one popular possibility. In a variable turbine geometry the guide vanes of the guide apparatus are aligned more or less steeply to the flow upstream of the turbine wheel according to the turbine power demand. In variable compressor geometry the diffusor vanes are aligned more or less steeply to the flow downstream from the compressor wheel. The vanes are generally adjusted via so-called adjusting levers which are moved by an adjusting ring located concentrically to the axis of the exhaust gas turbocharger. For radial turbines or radial compressors the guide vane or diffusor vane is generally parallel to the shaft axis. The shaft of the guide or diffusor vane is preferably supported twice in a housing and is turned by means of an adjusting lever which acts on the vane shaft between the two bearing points. DE 102 09 172 shows a conventional adjustable guide apparatus in which the adjusting lever after mounting the vanes is slipped onto the vane shaft and then fixed. The vane shaft can also be supported by means of an individual hole, as described in EP 1 396 621. Here the adjusting lever is also mounted subsequently after inserting the vanes.

The precisely machined joint between the slipped-on adjusting lever and the blade shaft on the one hand causes additional costs and on the other hand reduces the operating reliability of the adjustment mechanism. Relative movements which can consequently lead to wear over a longer operating time occur in the connection due to the production- and installation-induced plays.

EP 1 234 950 A1 discloses a guide device with adjustable guide vanes which are made in one piece and which are pivotally supported in hemispherical bearing openings which are opened on one aide. The bearing openings are closed with a straight cover so that the guide vanes do not fall out with the corresponding loading in the direction of the cover. In the area of the cover the bearing points of the guide vanes experience high surface pressure due to the linear support. This can lead to wear phenomena on the guide vanes and bearing opening.

SUMMARY

A guide device is disclosed which operates reliably over a long operating time, with adjustable guide vanes.

The guide vanes can be supported in a two-part or multipart housing which therefore surrounds for example a radially outer peripheral ring and a radially inner housing part. Housing separation takes place radially in the region of the bearing point of the vane shaft so that the separating joint between the housing parts leads through the bearing openings which are designed to hold the vane shafts.

In one exemplary embodiment the two partial openings of the bearing opening for holding the vane shafts are each in the shape of a circular arc so that together they form a complete circular opening when the two housing parts are mounted. Regardless of the loading direction, the cylindrical vane shafts thus sit over a large area in the round opening.

In another embodiment the guide device is equipped with guide vanes which have adjusting levers which are materially joined to the vane shaft. In this way the number of components to be used can be reduced by the additional adjusting levers. Moreover, the connecting zone between the adjusting lever and the vane shaft which is heavily loaded during operation can be eliminated.

The guide vane can be produced in one embodiment in one piece as a precision casting with the vane profile, the vane shaft and the adjusting lever. The adjusting lever is thus an integral component of the vane shaft.

Integration of the adjusting lever in the vane shaft greatly facilitates the installation of the adjustable guide device and yields much greater reliability of the guide device in long-term operation.

BRIEF DESCRIPTION OF THE DRAWINGS

Various embodiments of the invention are detailed below using the drawings.

DETAILED DESCRIPTION

Figure 2:
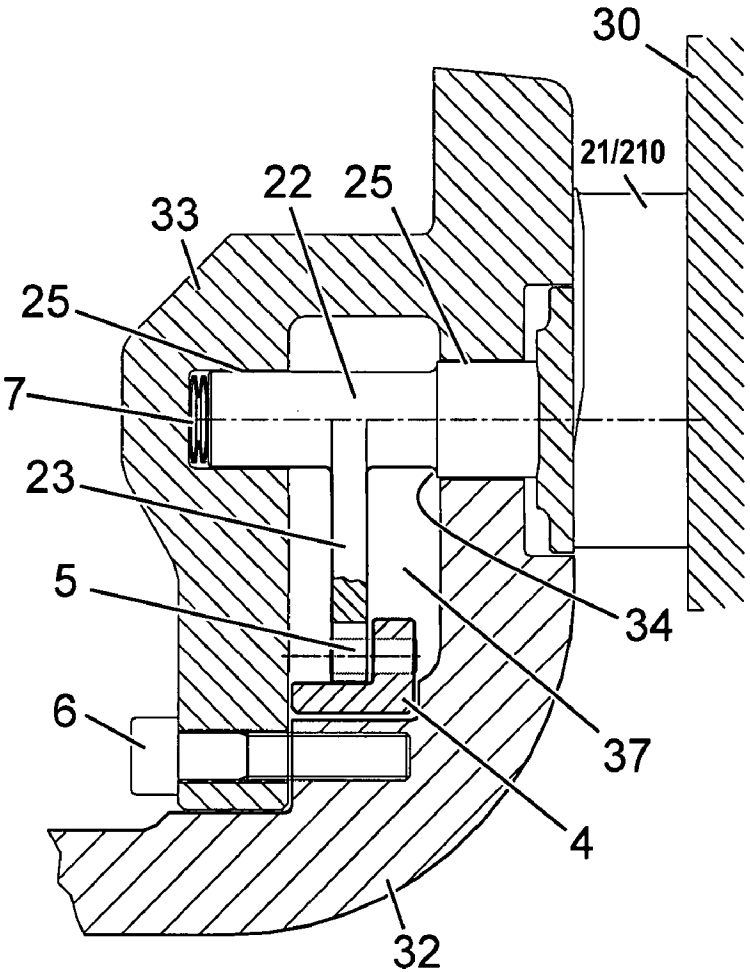
FIG. 2 shows an enlarged extract of the guide device as shown in FIG. 1.
Figure 1:
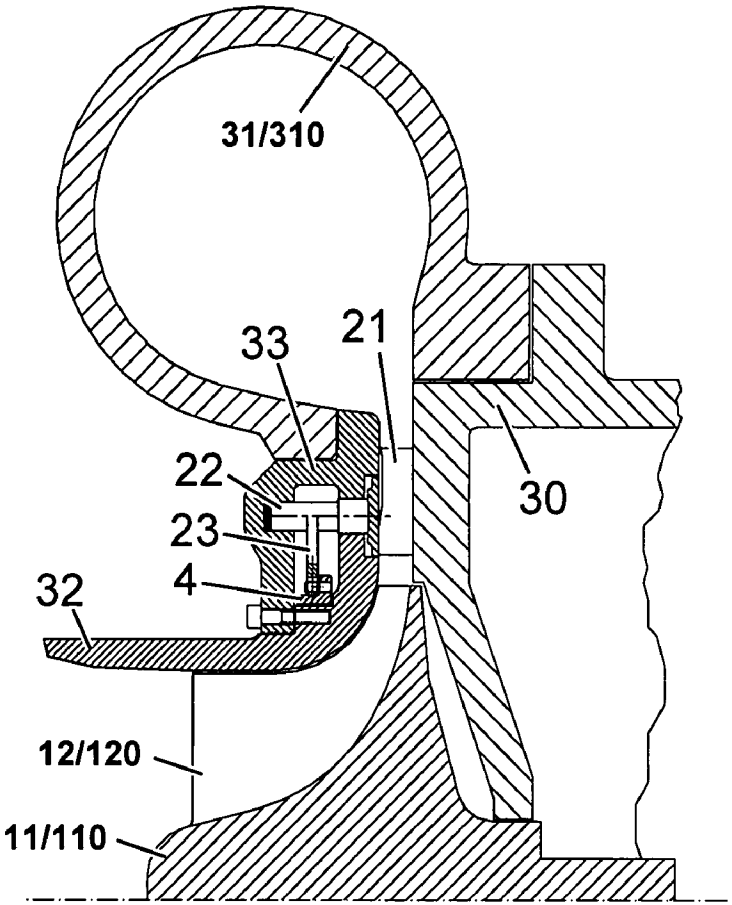
FIG. 1 shows a section routed along the axis through an exemplary compressor with a guide device as claimed in the invention.

FIGS. 1 and 2 show an exemplary compressor as is used for example in exhaust gas turbochargers, with a guide device.

The illustrated radial compressor comprises a compressor wheel which is located on a shaft which is pivotally mounted in the bearing housing 30. The compressor wheel has a hub 11 with a host of a rotor blades 12. The compressor wheel hub together with an insert wall 32 borders a flow channel. In the flow direction downstream of the compressor wheel the flow channel is bordered by the bearing housing and the compressor exit housing 31. In the region of the diffusor, downstream from the compressor wheel, there is an adjustable diffusor guide device.

This guide device comprises a plurality of adjustable guide vanes 21 which can each be rotated around a pivotally mounted vane shaft 22. The guide vane and the vane shaft can be connected to one another by a force-fit, form-fit or materially.

The vane shaft is pivotally mounted in a housing. To drive the vane shaft there is an adjusting lever 23 which transmits force from an adjusting ring 4 to the vane shaft. The adjusting lever is for example cast and/or milled with the vane shaft as a single component.

In one exemplary embodiment the guide vane 21, the vane shaft 22 and the adjusting lever 23 are materially joined to one another. For example, due to the fact that the guide vane, vane shaft and adjusting lever are cast and/or milled as a single component.

The housing which borders the flow channel in the region of the guide device is divided into two parts in the radial direction. In addition to the insert wall 32, it comprises a peripheral ring 33 which is located radially outside of the insert wall. In the peripheral ring and in the insert wall there are bearing points 25 for supporting the vane shaft, as can be taken from the enlargement in FIG. 2. Instead of the illustrated exemplary embodiment with two relatively short bearing points on either side of the adjusting lever 23, another embodiment with only one bearing point of the vane shaft is also conceivable. In the illustrated exemplary embodiment the rotor blades are pressed against the opposing wall of the bearing housing 30 by means of a spring 7 which acts on the end of the vane shaft.

Figure 3:
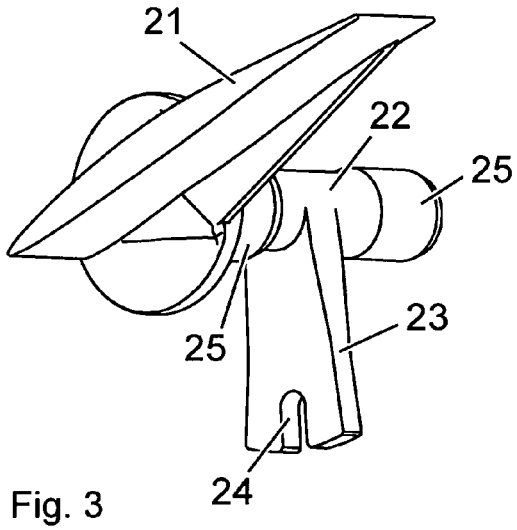
FIG. 3 shows an isometric detail of the guide vane of the guide device as shown in FIG. 1.

FIG. 3 shows an isometric representation of an exemplary guide vane. The actual guide vane 21 is located essentially perpendicular to the axis of the vane shaft 25. The adjusting lever 23 is located between the two bearing points 25 of the vane shaft. In the illustrated exemplary embodiment the lever is made straight and is likewise essentially perpendicular to the axis of the vane shaft. Alternatively the adjusting lever could have a bent shape and could be tilted roughly at a slight angle to the axis of the vane shaft.

An elongated groove 24 is inlet into the free end of the adjusting lever and in it the driving pin of an adjusting ring for driving the adjusting lever can be held. The elongated groove can also be made as a slot in which the driving pin can move back and forth, but which prevents the driving pin from being pulled entirely out of the groove.

Figure 4:
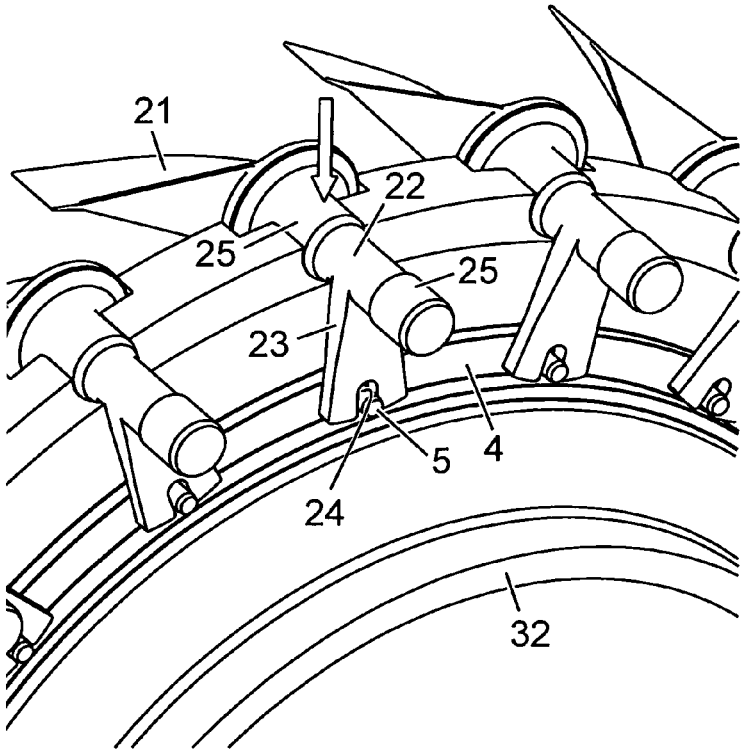
FIG. 4 shows an isometric representation of the guide device as shown in FIG. 1.

FIG. 4 shows how driving of the adjusting lever can take place via the adjusting ring 4 which is located concentrically to the charger axis. The adjusting ring has one cylindrical driving pin 5 per adjusting lever 23. If the adjusting ring is moved in the peripheral direction, the driving pins in the grooves 24 act on the adjusting levers and turn them around the axes of the peripherally mounted vane shafts 22. The free ends of the adjusting levers are rounded so that they do not stick when the adjusting ring is moving. In this figure the peripheral ring is not placed on the insert wall 32. The bearing points of the vane shaft near the vanes are located in bearing openings which are each roughly half inlet into the insertion wall and into the peripheral ring which can be moved in the axial direction over the insert wall.

Figure 5:
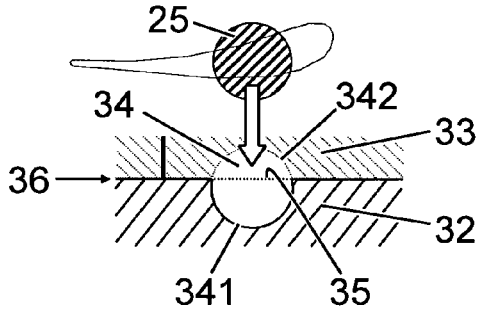
FIG. 5 shows a section through a bearing point of the guide vane when the guide vane is being mounted.

If the portion 341 of the bearing opening 34 in the insert wall 32 as is shown in FIG. 5 comprises more than half of the round opening, when the vane shafts 22 are inserted in the direction of the arrow a slight resistance arises which must be overcome before the vane shaft snaps in the bearing opening. The slight resistance results from the width of the insertion opening 35 being slightly smaller than the diameter of the vane shaft 22. After insertion, the vane shaft can turn freely, but does not fall out of the bearing opening without a further, slight expenditure of force in the radial direction. This facilitates mounting of the guide device on the insert wall.

An exemplary bearing opening can be comprised of two partial openings 341 and 342 with the shape of a partial circular arc, and combined in cross section—therefore perpendicular to the bearing axis of the vane shaft—yield a completely round opening 34. The separating joint 36 between the two housing parts, the insert wall 32 and the peripheral ring 33 leads as through the opening 34. The completely round opening 34 leads to the bearing point 33 of the vane shaft having large-area support in any position. Regardless of the loading direction, the cylindrical shaft sits flat in the round opening. Thus, high surface pressures can be avoided which arise when the vane shaft is supported in a non-round or only partially round opening.

If the vane-shaft has a region with a diameter which has been reduced relative to the bearing point 25, the vane shaft with the region with a reduced diameter can be inserted into the bearing opening and then pushed in the axial direction into the definitive position.

Before the guide vanes with the vane shafts are inserted into the bearing openings of the insert wall which are intended for this purpose, the adjusting ring 4 is placed in a recess of the insert wall intended for this purpose. If then all guide vanes are inserted, the peripheral ring 33 can be pushed in the radial direction over the insert wall so that the free ends of the vane shafts 22 are inserted into the openings in the peripheral ring which are intended for this purpose and which are equipped with spring elements 7. The adjusting ring 4 is advantageously axially guided, for example via the corresponding axial stops on the insert wall and/or on the peripheral ring. The peripheral ring is finally attached to the insert wall by fastening means 6. The adjustable guide device can then be installed together with the insert wall on the central opening of the compressor housing 31.

The cavity 37 which is surrounded by the insert wall 32 and the peripheral ring 33 (see FIG. 2) can be completely sealed against the vicinity. The cavity on only one side has an open housing interface. On the back wall in which the second guide vane bearing point is advantageously located in a non-through opening (blind hole), there need be an opening for a positioning lever for driving the adjusting ring 4 at only one location. Such an opening, generally a round hole, can be easily sealed. Otherwise the insert wall and peripheral ring always lie wall to wall so that the flow medium cannot escape from the flow channel through the guide device. The flow medium can optionally penetrate through the bearing opening 34 into the cavity 37, but cannot escape from there into the vicinity.

The combination of guide vanes made in one piece and the sealed cavity can be implemented due to the division of the insert wall and peripheral ring as claimed in the invention.

The peripheral ring can alternatively also be made in several parts. In this way the several parts of the peripheral ring can be placed on the insert wall in the radial direction from the outside. This enables additional free construction space in the configuration of the adjustable guide device.

To improve the operating reliability of the adjusting lever-adjusting ring coupling the inherently cylindrically made driving pin which can freely rotate in a round opening in the adjusting ring can be made with two planar slide surfaces which rest on the correspondingly flat slide surfaces of the groove on the free end of the adjusting lever.

The exemplary guide devices can be inserted both in the compressor and/or turbine of an exhaust gas turbocharger for supercharging of two-stroke and four-stroke internal combustion engines and also in turbines for useful turbines operated with the exhaust gases of an internal combustion engine.

It will be appreciated by those of ordinary skill in the art that the exemplary guide devices described here can be embodied in various specific forms without departing from the essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced.

REFERENCE NUMBER LIST

11 compressor wheel hub
110 turbine-wheel hub
12 compressor rotor blades
120 turbine rotor blade
21 guide vane (diffusor vane)
210 guide vane (turbine)
22 vane shaft
23 adjusting lever
24 groove
25 bearing points
30 bearing housing
31 compressor housing
310 turbine housing
32 insert wall
33 peripheral ring
34 bearing opening
341 partial bearing opening in insert wall
342 partial bearing opening in peripheral ring
35 insertion opening
36 separating joint between the insert wall and peripheral ring
37 cavity
4 adjusting ring
5 driving pin
6 fastening element
7 spring element

The invention claimed is:

1. Guide device with adjustable guide vanes, which guide vanes are each connected to a vane shaft pivotally mounted in bearing openings of a housing and can be turned around the vane shaft with an adjusting lever which is connected to the vane shaft and which acts on the vane shaft, the housing comprising:

a radially inner housing part; and a radially outer peripheral ring, a separating joint between the radially inner housing part and the radially outer peripheral ring passing through the bearing openings, wherein the vane shaft has at least one bearing point for support in the housing, wherein the housing has a bearing opening in which the bearing point is pivotally mounted, and wherein the vane shaft is configured for insertion into the bearing opening in the radial direction through the insertion opening in the bearing opening, the insertion opening being made narrow such that, when inserted, the vane shaft will snap into the bearing opening as a resistance is overcome.

2. Guide device as claimed in claim 1, wherein each of the bearing openings comprises two partially circular arc-shaped holes, the first of the partially circular arc-shaped holes being inlet into the radially inner housing part, and a second partially circular arc-shaped hole being inlet into the radially outer peripheral ring.

3. Guide device as claimed in claim 1, wherein the radially outer peripheral ring and the radially inner housing part surround a cavity in which the adjusting levers are located.

4. Guide device as claimed in claim 1, wherein to mount the guide device the outer peripheral ring can be pushed in the axial direction over the guide vanes located in the radially inner housing part.

5. Guide device as claimed in claim 1, wherein to mount the guide device, the outer peripheral ring can be pushed in the axial direction over the radially inner housing part together with the guide vanes located in the outer peripheral ring.

6. Guide device as claimed in claim 1, wherein the vane shaft and the adjusting lever are materially connected to one another.

7. Guide device as claimed in claim 1, wherein the guide vane, vane shaft and adjusting lever are materially connected to one another.

8. Guide device as claimed in claim 1, wherein the vane shaft has at least one bearing point for support in the housing, and wherein the bearing point is located between the adjusting lever and the guide vane.

9. Guide device as claimed in claim 1, wherein the vane shaft has a region with a reduced diameter and wherein the vane shaft with the region with reduced diameter can be inserted into the bearing opening in the radial direction through the insertion opening in the bearing opening and then can be moved in the axial direction.

10. Compressor with a diffusor with adjustable diffusor vanes, the diffusor comprising a guide device as claimed in claim 1.

11. Exhaust gas turbocharger with a compressor as claimed in claim 10.

12. Exhaust gas turbine with a guide device as claimed in claim 1.

13. Exhaust gas turbocharger with an exhaust gas turbine as claimed in claim 12.

14. Guide device with adjustable guide vanes, which guide vanes are each connected to a vane shaft pivotally mounted in bearing openings of a housing and can be turned around the vane shaft with an adjusting lever which is connected to the vane shaft and which acts on the vane shaft, the housing comprising:

a radially inner housing part; and a radially outer peripheral ring, a separating joint between the radially inner housing part and the radially outer peripheral ring passing through the bearing openings, wherein the outer peripheral ring is made in several parts in a peripheral direction.

15. Guide device with adjustable guide vanes, which guide vanes are each connected to a vane shaft pivotally mounted in bearing openings of a housing and can be turned around the vane shaft with an adjusting lever which is connected to the vane shaft and which acts on the vane shaft, the housing comprising a radially inner housing part and a radially outer housing part, a separating joint between the radially inner housing part and the radially outer housing part passing through the bearing openings, which bearing openings have a round cross section and are composed of two partially circular arc-shaped holes, a first of the partially circular arc-shaped holes being inlet into the radially inner housing part, and a second partially circular arc-shaped hole being inlet into the radially outer housing part, wherein the vane shaft has at least one bearing point for support in the housing, wherein the housing has at least one of the bearing openings in which the bearing point is pivotally mounted, and wherein the vane shaft is configured for insertion into the at least one bearing opening in a radial direction through an insertion opening of the at least one bearing opening, the insertion opening being made narrow such that, when inserted, the vane shaft will snap into the bearing opening as a resistance is overcome.

16. Compressor with a diffusor with adjustable diffusor vanes, the diffusor comprising a guide device as claimed in claim 15.

17. Exhaust gas turbine with a guide device as claimed in claim 12.

* * * * *